United States Patent [19]

Everett

[11] 4,398,766

[45] Aug. 16, 1983

[54] BOAT SEAT MOUNTING STRUCTURE

[75] Inventor: Lynn E. Everett, New Philadelphia, Ohio

[73] Assignee: Tusco, Inc., Gnadehutten, Ohio

[21] Appl. No.: 257,811

[22] Filed: Apr. 27, 1981

[51] Int. Cl.[3] ..... A47C 1/08

[52] U.S. Cl. ..... 297/252; 114/363; 248/410; 297/363

[58] Field of Search ..... 248/410; 297/252, 230, 297/349; 114/188, 194, 363

[56] References Cited

U.S. PATENT DOCUMENTS

| | | | |
|---|---|---|---|
| 2,841,207 | 7/1958 | Sweeney | 297/252 |
| 2,843,348 | 7/1958 | Samuels | 114/363 X |
| 3,113,804 | 12/1963 | Ritter | 297/252 |
| 3,539,142 | 11/1970 | Morand | 248/410 X |
| 3,718,365 | 2/1973 | Gibson | 114/363 |
| 3,789,444 | 2/1974 | McCord | 114/363 |
| 3,821,825 | 7/1974 | Bailey | 114/363 |
| 3,858,935 | 1/1975 | Pask | 248/410 X |
| 4,098,485 | 7/1978 | Mizelle | 297/349 X |
| 4,281,426 | 8/1981 | Moeser | 114/383 |
| 4,314,591 | 2/1982 | Pierrat | 248/410 X |

FOREIGN PATENT DOCUMENTS

| | | | |
|---|---|---|---|
| 426880 | 4/1935 | United Kingdom | 248/410 |
| 599447 | 3/1948 | United Kingdom | 248/410 |

*Primary Examiner*—James T. McCall

*Attorney, Agent, or Firm*—Wilson, Fraser, Barker & Clemens

[57] ABSTRACT

A removable seat for attachment to a support, such as the thwart of a boat, having a mounting housing rotatably secured to the base of the seat. A plurality of support-engaging members are slidably disposed in the housing for removably attaching the seat to the support. Each of the support-engaging members includes a cylindrical bar having an L-shaped end portion to which a rubber disk is attached. Locking means releasably secure each of the support-engaging members to the housing. Each locking means includes a lever which is pivotally attached to the housing and has detent means formed therein for slidably receiving one of the support-engaging members. A resilient means, such as a spring, is disposed between a pair of levers for urging the detent means carried thereby into frictional engagement with the support-engaging member.

10 Claims, 3 Drawing Figures

BOAT SEAT MOUNTING STRUCTURE

BACKGROUND OF THE INVENTION

1. Field of the Invention

The present invention relates in general to a removable seat for attachment to a support and in particular to a boat seat mounting structure including a rotatable seat mounted on a base which slidably holds a plurality of support-engaging members selectively adjustable to accommodate different widths of boat thwarts.

2. Description of the Prior Art

Small boats are provided with thwarts upon which passengers can be seated. Typically, a thwart consists of a flat wooden or metallic plank extending transversely across the boat. Such planks are uncomfortable to sit on for long periods of occupancy in the boat. Furthermore, such thwarts do not have back rests which provide back support for the passengers. Thus, it would be desirable to provide a boat seat mounting structure which could be removably secured to the thwart for providing greater passenger comfort.

A number of boat seat attachments are known in the art. Such attachments generally vary as to the means for releasably securing the seat base to the thwart of the boat. For example, U.S. Pat. No. 2,843,348 to Samuels discloses a detachable mounting for boat seats wherein a plurality of thwart-engaging cams are rotatably mounted on opposing ends of a pair of telescoping inner and outer members. A crank is journalled for rotation in the outer end of the outer member and is in unitary assembly with a rod disposed therein. The rod has a screw-threaded inner end disposed in a complementary screw-threaded recess in the inner end of the inner member. Rotation of the crank rotates the rod and, therefore, causes the cams to move together and grip the boat thwart. Similarly, U.S. Pat. No. 3,591,112 to Garmhausen discloses a boat seat clamp having a horizontal bar which can be adjusted lengthwise. A clamp member is slidably mounted on one end of the bar and locked to the bar by cam action under clamping pressure applied by an operator so as to frictionally engage the thwarts.

U.S. Pat. No. 3,718,365 to Gibson discloses a seat attachment for boats which includes a rectangular, tubular main frame having clamp means for detachably securing the frame to the sides of the boat. A sub-frame carrying a seat is engaged with opposite sides of the tubular main frame to permit sliding adjustment of the sub-frame longitudinally of the main frame. U.S. Pat. No. 3,789,444 to McCord discloses a boat seat holder assembly including a pair of bracket plates interconnected by a swivel plate seat mounting assembly. The forward plate has a substantially monoplanar main plate portion with a turned-over flange at the forward edge thereof. The rear bracket plate has a substantially monoplanar main portion with a first flange portion bent from and extending at a right angle to the main plate portion. The front and rear bracket plates cooperate to frictionally engage the permanent seat of a boat.

U.S. Pat. No. 3,821,825 to Bailey discloses a removable boat seat attachment having a seat rotatably mounted on a base member. The base member has seat board engaging members which cooperate with an adjustable clamp having seat board engaging portions such that the engaging member and the clamp engage opposite edges of the seat board for securing the base member thereto. Quick release locking-type fasteners have portions secured to the base member and the clamp for urging and normally maintaining the seat board engaging portions in clamping engagement and removably securing the boat seat attachment thereto.

The boat seat constructions of the prior art suffer from several deficiencies. Many of such constructions are not adaptable to thwart structures of different sizes. Others require time-consuming effort to attach the seat to the thwart and release it therefrom. Those constructions which avoid these problems suffer from expensive and complicated mounting structures.

SUMMARY OF THE INVENTION

The present invention relates to a boat seat mounting structure which avoids the problems apparent from the prior art. A seat is rotatably secured to a mounting housing. The housing includes a plurality of thwart-engaging members which removably secure the housing to a support such as the thwart of a boat. The housing can include four independently adjustable members, each of which are selectively extendable in length to accommodate different thwart sizes. Each member includes a projecting cylindrical bar having an L-shaped end portion terminating in a support-engaging disk formed of hard rubber. Locking means releasably secure each of the support-engaging members to the housing. Each of the locking means includes a lever which is pivotally attached to the housing. Each lever includes detent means formed therein for slidably receiving one of the support-engaging members. A resilient means, such as a spring, is attached between a pair of levers for urging the detent means into frictional engagement with the received member.

It is an object of the present invention to provide a seat mounting structure for boat thwarts and other supports of varying sizes.

It is another object of the present invention to provide a boat seat mounting structure which is reliable and still quickly and easily removed when desired.

It is a further object of the present invention to provide a boat seat mounting structure which is simple in construction and inexpensive to manufacture.

Other objects and advantages of the present invention will become apparent to those skilled in the art from the following detailed description of the preferred embodiments of the invention, when read in light of the accompanying drawings.

DETAILED DESCRIPTION OF THE PREFERRED EMBODIMENT

Figure 1:
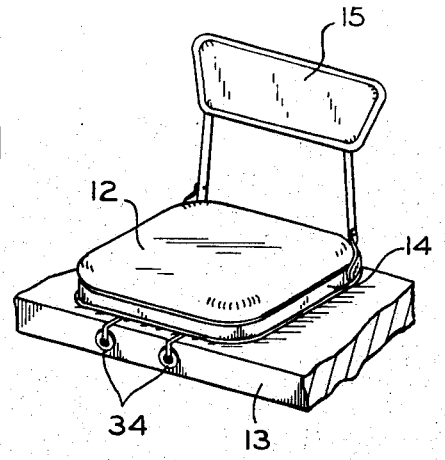
FIG. 1 is a perspective view of a boat seat mounting structure in accordance with the present invention, showing the position of the seat in use.
Figure 2:
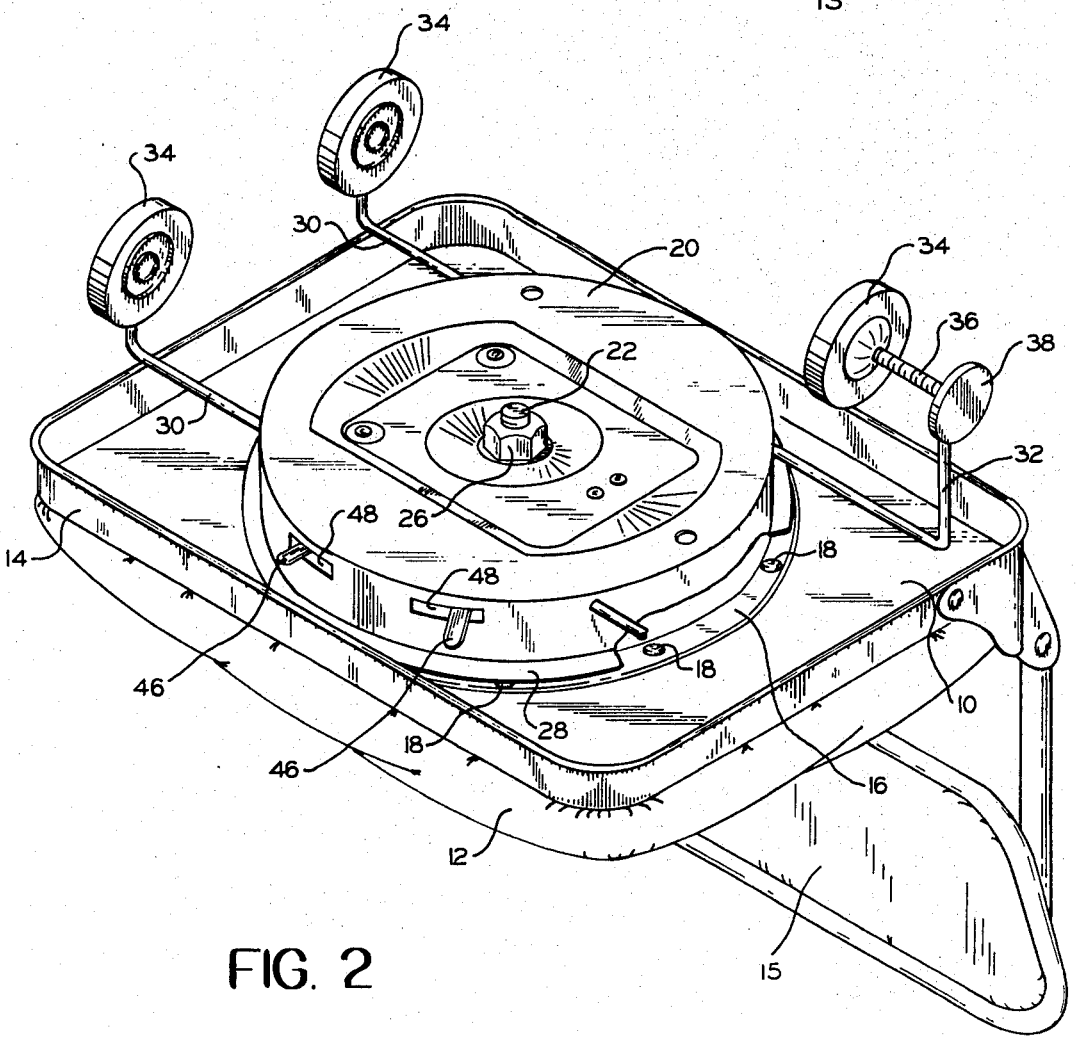
FIG. 2 is a perspective view, partially broken away, of the bottom side of the boat seat mounting structure of FIG. 1.

Referring now to the drawings, there is illustrated in FIGS. 1 and 2 a boat seat mounting structure in accordance with the present invention. Although the mounting structure will be described in its preferred embodiment as a seat for the thwart of a boat, it will be appreciated that the present invention can be utilized to provide a secure and comfortable resting place on virtually any type of bench or bleacher seat. The seat structure includes a rigid seat base 10 to which a seat cushion 12 is attached. The seat base 10 is mounted on a boat thwart of bench-type support 13 and is provided with a downwardly depending rim 14 which extends about the base 10 to increase the strength and decrease the flexing when the seat is in use. A conventional seat back 15 can be attached to the base 10 to provide back support for the occupant of the seat. The seat back 15 can be permanently secured to the base 10 or provided with a hinge so that the seating unit can be folded for convenience.

The base 10 has an annular track portion 16 formed therein which extends slightly outwardly of the generally flat surface of the base 10. A plurality of spaced bearing pads 18 are positioned in an annular array about the track 16. The bearing pads 18 may be of any suitable shape and are typically secured in an appropriate manner to the track portion 16 of the base 10. Manifestly, the bearing pads 18 can be secured to the flange portion 16 of the base 10 by being cast or heat sealed in place of a suitable adhesive, thus obviating the need for forming apertures in the flange portion 16. It has been found that satisfactory results may be achieved by providing ten equidistantly-spaced pads 18 throughout the track 16, although, as will become apparent below, a greater or fewer number of pads 18 could be employed. Preferably, the pads 18 are formed of a hard plastic material, such as polyvinyl chloride, although the materials could be employed.

A mounting housing 20 is rotatably secured to the base 10 by an externally threaded fastener 22 which extends through an aperture 24 formed in the housing 20. An internally threaded nut 26 is adapted to be threadably engaged to the distal end of the threaded fastener 22. The fastener 22 defines the axis of rotation of the housing 20. The housing 20 includes a flange portion 28 which extends outwardly from the perimeter of the housing 20. The flange 28 portion is formed to be co-extensive with and over-lay the track portion 16 containing the annular array of bearing pads 18.

In operation, the flange 28 slidably engages and rotates upon the bearing pads 18. Due to the facts that the pads 18 are raised above the generally planar surface of the base 10, the flange 28 and the flange portion 16 are maintained out of direct contact during the relative rotational movement therebetween. Thus, the surface area contacting the flange 28 is relatively small, thereby reducing the undesirable effects of friction and permitting the seat to be rotatably adjusted easily and without the need for any additional lubrication.

Figure 3:
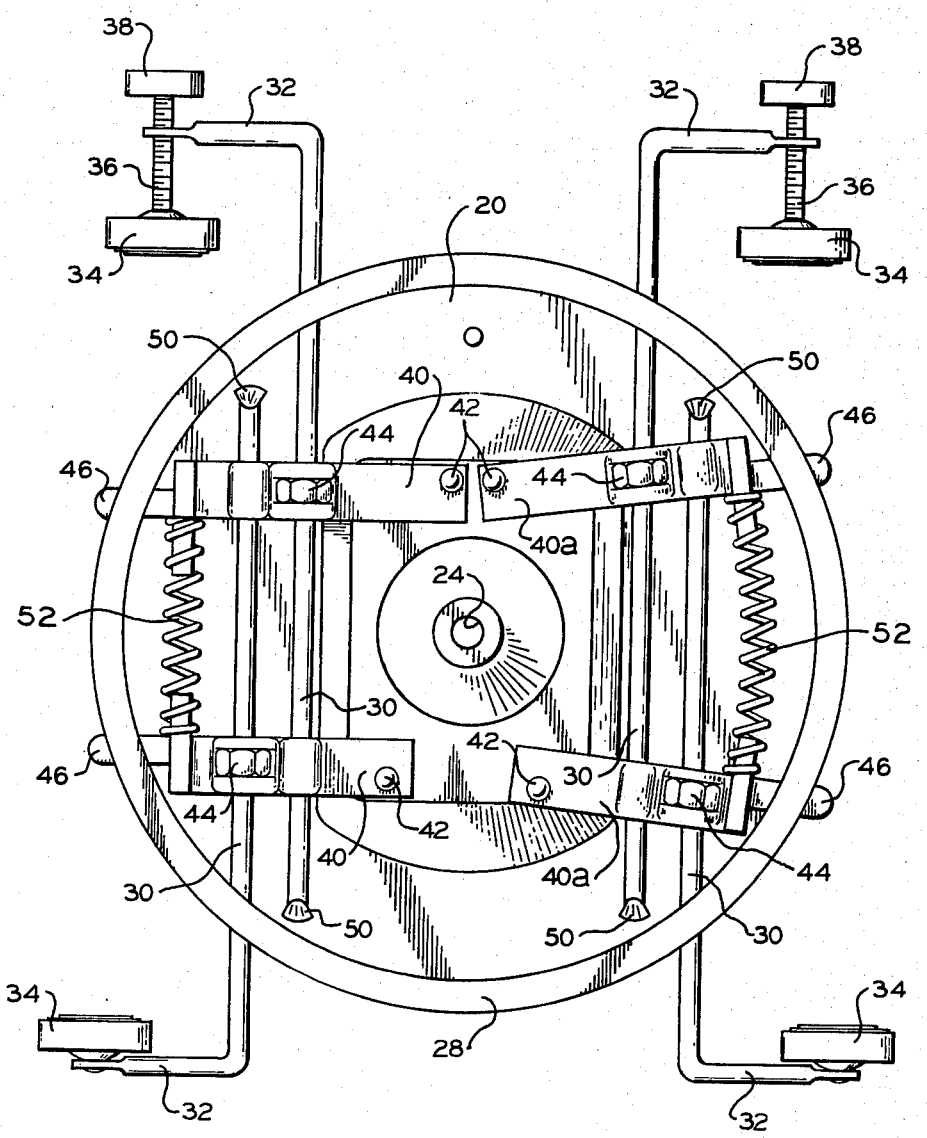
FIG. 3 is a top plan view of the mounting housing shown removed from the boat seat mounting structure of FIG. 2.

The construction and operation of the mounting housing 20 are more clearly illustrated in FIG. 3. A plurality of support-engaging members are slidably disposed in the housing 20 for removably attaching the seat to the support 13. In the illustrated embodiment, each of the four support-engaging members includes a cylindrical bar 30 having an L-shaped end portion 32. Attached to the L-shaped end portion 32 of each bar 30 is a support-engaging disk 34, preferably formed of hard rubber, wherein at least one pair of spaced disks secure the seat to the support 13 and prevent scratching. Some or all of the end portions 32 can include a screw means, such as a threaded screw 36 having a head portion 38, for adjusting the position of the disk 34 relative to the end portion 32. In FIG. 3, the screw 36 extends through a cooperating aperture formed in the end portion 32 into engagement with the disk 34. The screw 36 can be attached to the disk 34 by any conventional means. By tightening the screws 36, a user of the seat can more firmly secure the seat to the support 13.

The housing 20 includes locking means for releasably and independently securing each of the support-engaging members to the housing 20. Each locking means includes levers 40 and **40*a*, each of which is pivotally attached at one end to the housing 20 as at 42. The levers 40 are shown in an unlocked position while the levers 40*a* are shown in a locked position as illustrated in FIG. 3. Accordingly, only one arm 40 need be described. Each line 40 and 40*a* includes detent means formed therein for slidably receiving one of the support-engaging members. In the illustrated embodiment, the detent means comprises a threaded nut 44 which is secured to each lever 40 and 40*a* in a cooperating recess although the nut 44 may be secured in any conventional manner. As shown clearly in FIG. 3, the bar 30 extends through the nut 44 of one lever 40 into a slot formed in a cooperating lever 40. Each lever 40 includes a handle portion 46 which extends through a corresponding slot 48 formed in the mounting housing 20 (See FIG. 2) for permitting an operator to move the lever 40** from a locked to an unlocked position, as will be described below.

By moving the lever 40 into the position indicated in FIG. 3, the axis of the nut 44 is coaxial with the cylindrical bar 30, thus disengaging the nut therefrom as the diameter of the aperture of the nut 44 is slightly larger than the diameter of the bar 30. Accordingly, the bar 30 is free to slide through the nut 44, the locking arm 40, and the mounting housing. In this manner, the seat can be adjusted to fit over supports of different sizes. The bar 30 can include a crimped end portion 50 to prevent the bar 30 from sliding completely out of the locking means and off of the seat.

When the levers **40*a* are moved into the position shown in FIG. 3, the axis of the nut 44 is no longer coaxial with the cylindrical bar 30. In such position, the threads of the nut 44 frictionally engage the cylindrical bar 30 extending therethrough. Such engagement of the bar 30 by the nut 44 prevents further sliding of the bar 30 and holds it in a desired position. It will be appreciated that the distance by which the levers 40 and 40*a* must pivot in order to lock the cylindrical bar 30 in a desired position can be varied according to the relative sizes of the diameters of the bar 30 and the aperture of the nut 44**.

Resilient means, such as springs 52 may extend between a pair of levers 40 and a pair of levers **40*a* for urging the detent means into frictional engagement with the support-engaging member. In the illustrated embodiment, the spring 52 is attached between opposing pairs of the levers 40 to simultaneously urge each lever 40** and its corresponding detent means into frictional engagement with the support-engaging member. It can thus be appreciated that a user of the seat can selectively extend one or more of the support-engaging members independently of the other members.

In accordance with the provisions of the patent statutes, the principle and mode of operation of the present invention have been explained and illustrated in their preferred embodiment. However, it must be appreciated that the invention can be practiced otherwise than as specifically illustrated and explained without departing from its spirit or scope.

I claim:

1. A removable seat for attachment to a support comprising:

a mounting housing secured to the seat;

a plurality of support-engaging members slidably disposed in said housing for removably attaching the seat to the support; and locking means for releasably securing each of said support-engaging members to said housing, each of said locking means including a lever pivotally attached to said housing having detent means formed therein for slidably receiving one of said members and resilient means attached to said lever for urging said detent means into frictional engagement with said member, said lever including a handle portion extending outwardly from said housing whereby said lever can be moved in opposition to said resilient means to disengage said support-engaging member from said housing.

2. A removable seat in accordance with claim 1 wherein said mounting housing is rotatably secured to the seat.

3. A removable seat in accordance with claim 2 wherein the seat includes a plurality of bearing pads arranged in an annular array and said mounting housing includes a flange portion generally co-extensive with said array, whereby said flange portion slidably engages said pads to permit rotation of said mounting housing relative to the seat.

4. A removable seat in accordance with claim 1 wherein each of said plurality of support-engaging members includes a cylindrical bar having an L-shaped end portion.

5. A removable seat in accordance with claim 4 including a support-engaging disk attached to said L-shaped end portion.

6. A removable seat in accordance with claim 5 wherein said L-shaped end portion includes screw means for adjusting the position of said disk relative to said end portion.

7. A removable seat in accordance with claim 1 wherein said detent means comprises a threaded nut secured to said lever.

8. A removable seat in accordance with claim 7 wherein said nut is held by said support-engaging member in a recess formed in said lever.

9. A removable seat in accordance with claim 1 wherein said resilient means is a spring.

10. A removable seat in accordance with claim 9 wherein said spring is attached between opposing pairs of said levers for urging said detent means carried by said levers into frictional engagement with said support engaging members.

* * * * *